US006863085B2

(12) United States Patent
Marty et al.

(10) Patent No.: US 6,863,085 B2
(45) Date of Patent: Mar. 8, 2005

(54) FAUCET MANIFOLD ASSEMBLY WITH IN-LINE INTEGRAL STOPS

(75) Inventors: Garry Robin Marty, Fishers, IN (US); Gerald J. McNerney, Carmel, IN (US)

(73) Assignee: Masco Corporation of Indiana, Indianapolis, MN (US)

( * ) Notice: Subject to any disclaimer, the term of this patent is extended or adjusted under 35 U.S.C. 154(b) by 161 days.

(21) Appl. No.: 10/278,407

(22) Filed: Oct. 23, 2002

(65) Prior Publication Data

US 2004/0079422 A1 Apr. 29, 2004

(51) Int. Cl.[7] ..... F16K 11/07
(52) U.S. Cl. ..... 137/606; 137/550; 251/250
(58) Field of Search ..... 137/606, 607, 137/550; 251/250

(56) References Cited

U.S. PATENT DOCUMENTS

| | | | | | |
|---|---|---|---|---|---|
| 368,849 | A | * | 8/1887 | Paton | 251/250 |
| 1,763,942 | A | * | 6/1930 | Baker | 251/257 |
| 1,887,694 | A | * | 11/1932 | Masker | 251/250 |
| 2,041,371 | A | * | 5/1936 | Rice | 251/250 |
| 3,368,582 | A | * | 2/1968 | Kozel et al. | 137/549 |
| 3,529,621 | A | * | 9/1970 | Christiansen | 137/315.26 |
| 4,413,804 | A | * | 11/1983 | Lanius et al. | 251/144 |
| 4,533,115 | A | * | 8/1985 | Lissau | 251/142 |
| 4,946,047 | A | | 8/1990 | Kurokawa et al. | |
| 5,049,269 | A | | 9/1991 | Shah | |
| 5,388,610 | A | * | 2/1995 | Chuang | 137/549 |
| 5,390,701 | A | | 2/1995 | Lessley et al. | |
| 5,439,199 | A | * | 8/1995 | Briggs et al. | 251/320 |
| 5,899,439 | A | * | 5/1999 | Gottwald et al. | 251/288 |
| 6,227,246 | B1 | | 5/2001 | Hall et al. | |
| 6,321,777 | B1 | | 11/2001 | Wu | |

* cited by examiner

*Primary Examiner*—Stephen M. Hepperle
(74) *Attorney, Agent, or Firm*—Carlson, Gaskey & Olds

(57) ABSTRACT

A shower faucet manifold assembly includes a manifold defining an inlet including first and second bores. The first bore is of a larger diameter than the second bore. Disposed within the first bore is a piston including an o-ring seal that engages the inner surface of the second bore to prevent water flow. The first and second bores are disposed along a common axis to enable manufacturing and fabrication from a common end.

28 Claims, 4 Drawing Sheets

FAUCET MANIFOLD ASSEMBLY WITH IN-LINE INTEGRAL STOPS

BACKGROUND OF THE INVENTION

This invention relates generally to a wall-type shower faucet manifold and specifically to a wall-type shower faucet manifold including an improved sealing configuration and features simplifying manufacture.

Typically, a wall-type shower faucet includes a manifold assembly positioned within a wall between a showerhead and a tub spout. The faucet manifold includes an inlet for hot and cold water and an outlet controlled by a mixing valve selectively in fluid communication with the showerhead or the tub spout. Filters have been included within the manifold assembly to filter out particles within the water supply. As appreciated, these filters must periodically be replaced or cleaned. It is known for the faucet manifold assembly to include a stop valve that interrupts the supply of water from the inlet to the outlet, allowing the change out or cleaning of filters without having to shutoff the main water supply.

Typically, the stop valves are configured with multiple bends to accommodate fabrication of a face sealing surface. A sealing washer is forced against the sealing face to prevent the flow of water. Water flowing through the stop valve encounters several direction changes to accommodate the configuration of the stop valve. In the valve chamber, a seal engages the sealing face. The sealing face must be of a specific surface finish in order to provide a watertight fluid seal. The configuration of the stop valve complicates fabrication and requires additional machining steps. Further, abrupt changes in water flow through the valve can result in undesirable flow noise.

Accordingly, it is desirable to develop and design a faucet manifold assembly that ease manufacturing, reduces costs and flow noise, while providing a watertight seal.

SUMMARY OF THE INVENTION

This invention is a wall-type shower faucet manifold assembly including an inlet having first and second bores disposed about a common axis simplifying manufacture and providing an integral sealing surface for the stop valve.

The wall-type shower faucet manifold assembly of this invention includes a housing defining a first inlet for fluid incoming at a first temperature and a second inlet for fluid at a second temperature and an outlet. Each of the inlets includes at a first bore and a second bore disposed about a common axis. A mixing valve assembly controls fluid flow between the first and second inlets through outlets leading to a showerhead and the tub spout. A filter assembly disposed within each inlet traps contaminants before reaching the mixing valve. Each inlet includes a stop valve to shutoff fluid flow through each of the first and second inlets to allow removal or replacement of the filter assembly without shutting off a main water supply. The stop valve includes a piston movable within the first bore to seal against inner walls of the second bore.

Accordingly, the wall-type shower faucet manifold of this invention provides an improved stop valve configuration to reduce flow noises, ease manufacturing, and increase flow.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
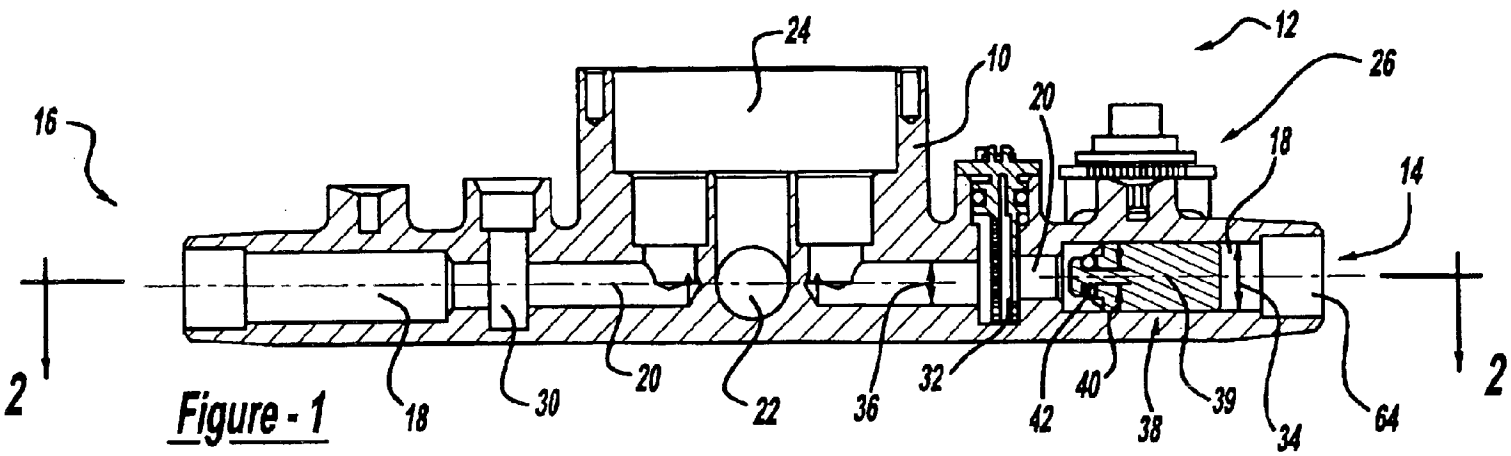
FIG. 1 is a cross-section side view of the faucet manifold.

Referring to the FIG. 1, the subject invention is a wall-type shower faucet manifold assembly 12 including inlets 14, 16 and outlets 22. Each of the inlets 14, 16 are comprised of a first bore 18 and a second bore 20. The first bore 18 and second bore 20 are disposed about a common axis 64. Because the bore 18, 20 are disposed about the common axis 64, both of the bores 18, 20 can be formed by a common tool or from a common fixturing of the manifold assembly 12. The use of a common tool or common fixturing reduces the number and cost of machining operations required to fabricate the manifold assembly 12.

The shower faucet manifold assembly 12 includes manifold 10 that defines the inlets 14, 16. The outlets 22 are in fluid communication with a mixing valve chamber 24. Each of the inlets 14, 16 includes a filter assembly 32. The filter assembly 32 is mounted within a filter cavity 30. The filter cavity 30 intersects the inlet 14, 16, and specifically the second bore 20. The filter assembly 32 is removable allowing replacement or cleaning.

Removal of the filter assembly 32 requires fluid entering the manifold 10 through one of the inlets 14, 16 to be shutoff. To stop the flow of fluid through the inlets 14,16, a stop valve 26 is disposed at each inlet 14, 16. In this view only one stop valve 26 is shown to illustrate the manifold 10 configuration supporting the stop valve 26. The stop valve 26 includes a piston 38 movable between an open and closed position. FIG. 1 illustrates the piston 38 in the open position. The piston 38 includes a sealing diameter 40 and a seal 42. The seal 42 is preferably an o-ring positioned on the sealing diameter 40. The o-ring 42 cooperates with the bore 20 to shut off fluid entering through the inlet 14. Because the bores 18, 20 are disposed along a common axis 64, the piston 38 is aligned within the first bore 18 and seals within the second bore 20. The first bore 18 includes an inner diameter 34 cooperating with a body portion 39 of the piston 38 to guide the piston 38 into the second bore 20. The second bore 20 includes a second inner diameter 36. The second inner diameter 36 cooperates with the outer diameter of the seal 42 to seal the water flow through the inlet 14 to the outlet 22.

Figure 2:
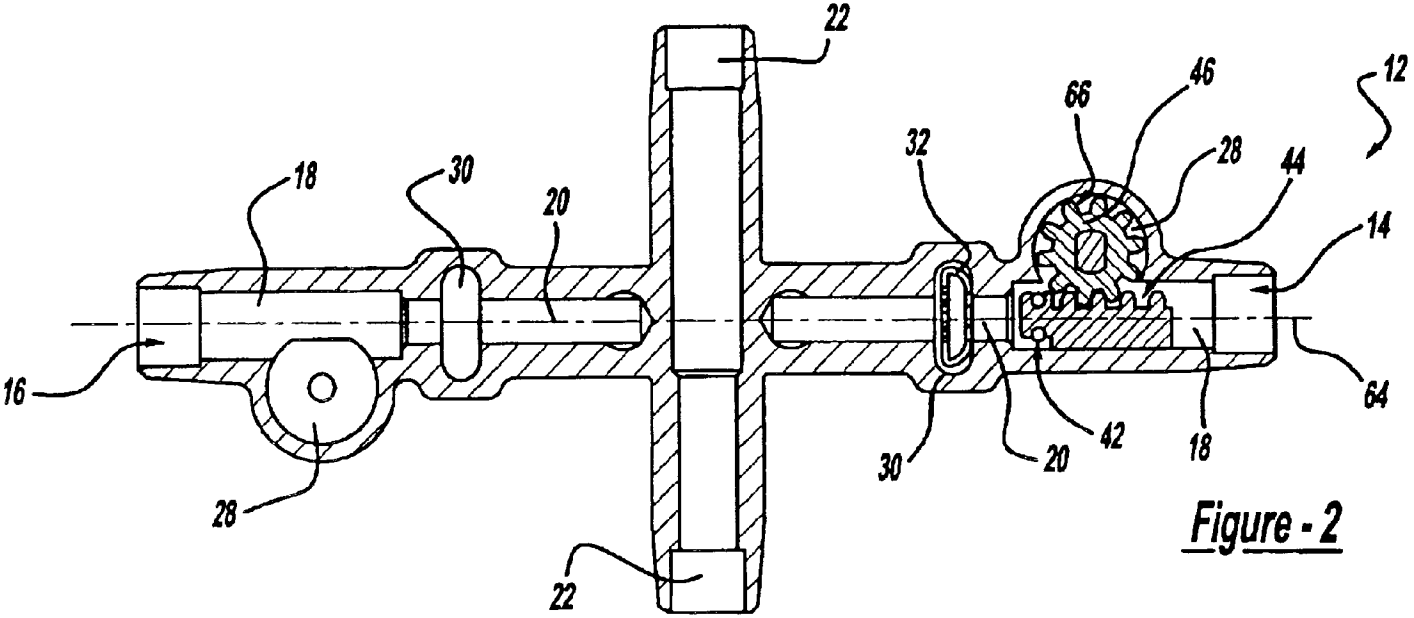
FIG. 2 is cross-sectional top view of the faucet valve assembly.

Referring to FIG. 2, a section of the manifold 10 is shown through a top of the faucet manifold assembly 12. The piston 38 includes a rack gear portion 44 cooperating with a gear portion 66 of stem 46. The stem 46 is positioned within bore 28 that opens into the first bore 18 of the inlet 14.

Figure 3:
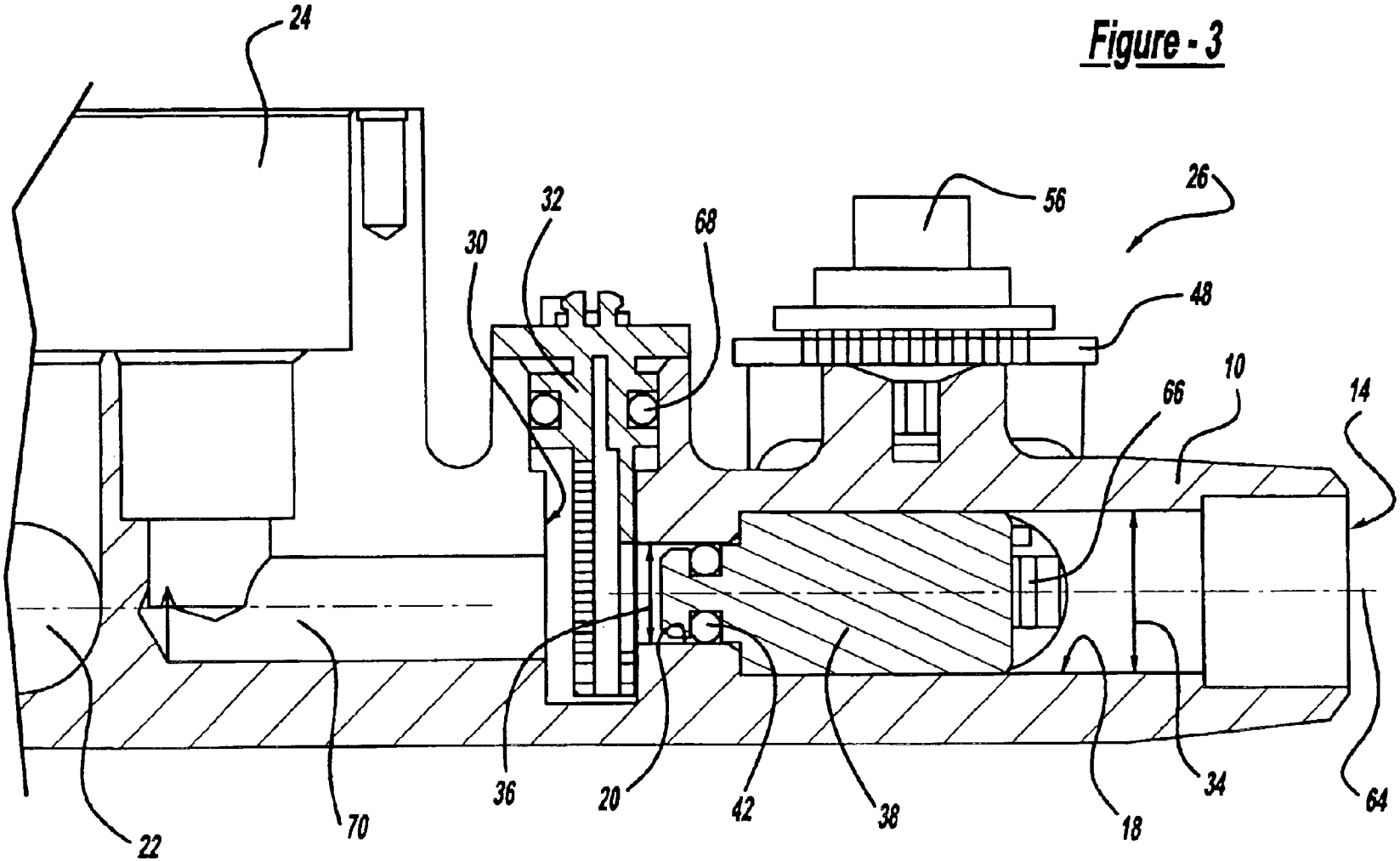
FIG. 3 is an enlarged cross-sectional view of the stop valve assembly.

Referring to FIG. 3, an enlarged cross-sectional view of the stop valve assembly 26 illustrates the piston 38 in a sealed position. In the sealed position the seal 42 is in sealing engagement with the inner diameter 36 of the second bore 20. The seal 42 engages the inner diameter 36 of the bore 20 to close off the flow of fluid through the inlet 14. In this position, fluid from the inlet 14 is prevented from progressing through an intermediate passage 70 to the mixing valve cavity 24, which ultimately directs fluid through outlets 22. The mixing valve 26 includes the stem portion 46 (shown in FIG. 2) held within the housing 10 by a bonnet 48. Disposed within and engagable with the bonnet 48 is a bushing 56. The bushing 56 is movable within the bonnet 48 and is guided along the stem 46. Stem 46 includes the gear portion 66 that is shown exposed within the bore 18.

The filter assembly 32 includes the seal 68. Preferably the seal 68 is an o-ring. However, other seals known to a worker skilled in the art are also within the contemplation of this invention. The filter assembly 32 is disposed within the filter cavity 30 and is removable to allow replacement or cleaning.

Figure 4:
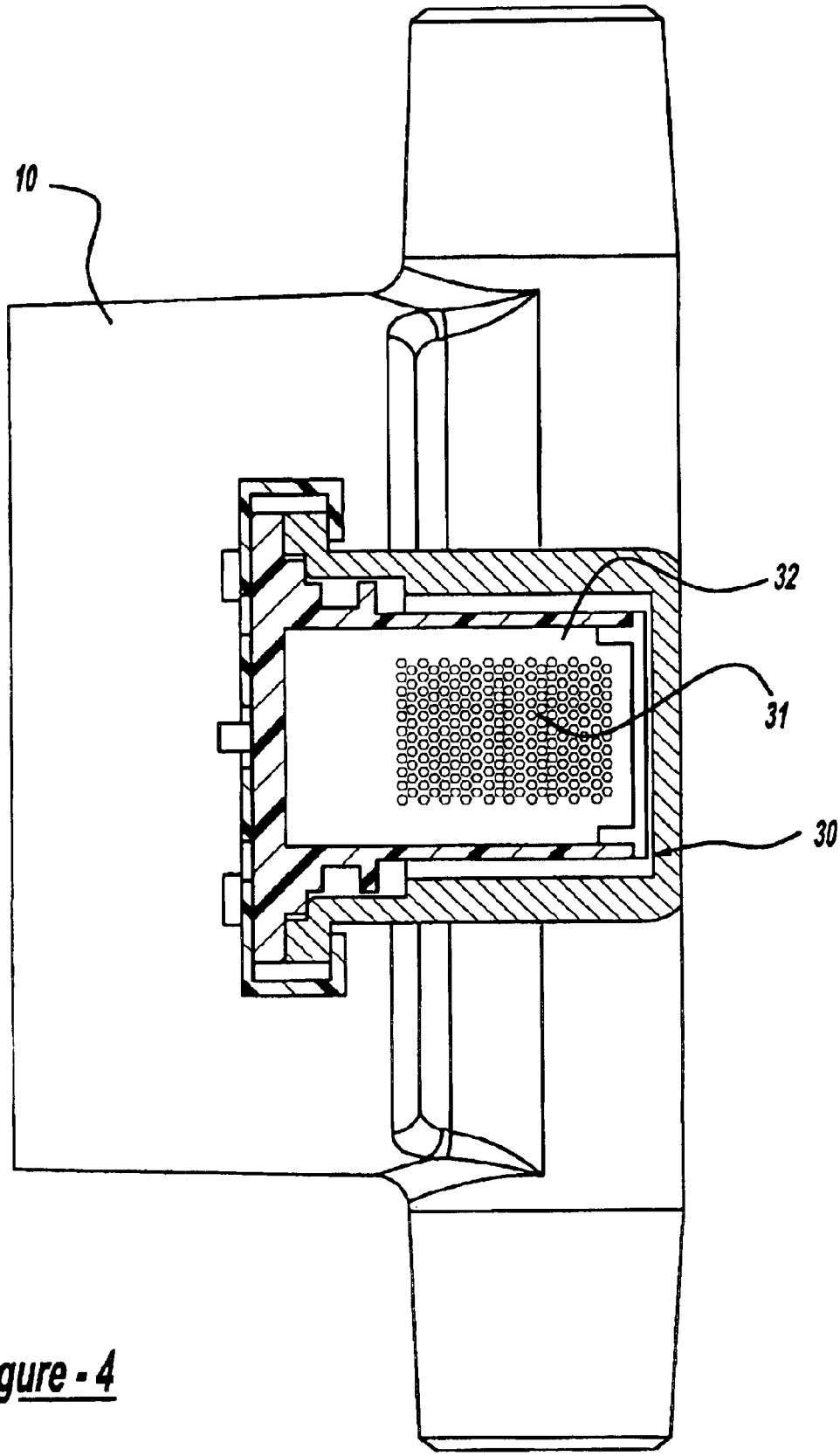
FIG. 4 is a cross-sectional view of the filter assembly.

Referring to FIG. 4, the filter assembly 32 is shown in cross-section to show and illustrate the filter media 31. As appreciated, any filter media as is known to a worker skilled in the art would fall within the contemplation of this invention. Further, although the specific configuration of the filter assembly 32 is shown as a generally rectangular shape with rounded ends, it is also within the contemplation of this invention that the filter assembly may be circular, rectangular or square or any other shape as is known to a worker skilled in the art.

Figure 5:
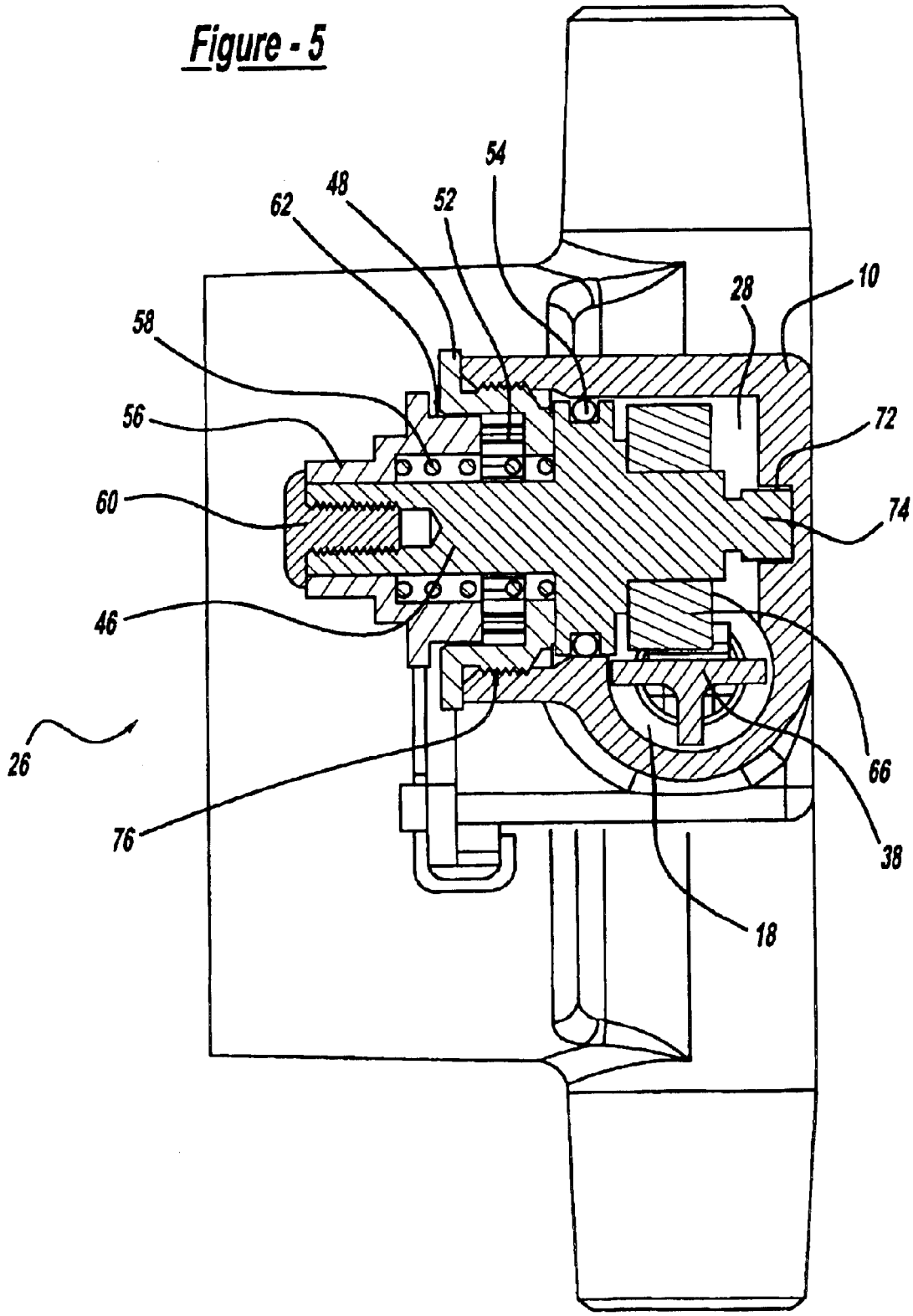
FIG. 5 is a cross-sectional view of the stop valve assembly.

Referring to FIG. 5, the stop valve 26 is shown in cross-section from a view looking into inlet 14. The stop valve 26 includes the stem 46 inserted within the bore 28 adjacent the first bore 20. The stem 46 includes a pilot portion 74 disposed within a pilot hole 72 fabricated within the manifold 10. The stem portion 46 also includes an o-ring land 55 for o-ring 54. This seals the stem within the bore 28 and prevents fluid migration passed the stem 46. Stem 46 is held within the cavity by the bonnet 48.

The bonnet 48 threadingly engages housing 10 to hold the stem within the manifold 10. The bonnet 48 includes a plurality of external threads 76 that engage corresponding threads fabricated within the manifold 10. The bonnet 48 includes an inner surface that defines an interlocking profile 52. The interlocking profile 52 corresponds to an interlocking profile on an outer surface of the bushing 62. The bushing 56 is biased upward out of the bonnet 48 by a biasing member 58. Preferably, the biasing member 58 is a compression spring.

The bonnet 48 is not rotatable relative to the stem 46. The stem 46 includes the gear portion 66 corresponding with the rack gear portion 44 of the piston 38. Rotation of the stem 46 moves the piston 38 between open and closed position. Movement of the stem 46 is accomplished by grasping the bushing 56 and turning. Rotation of the bushing 56 moves the piston 38 linearly within the bore 18 between open and closed positions.

The stop valve 26 is normally in an opened position. To maintain an open position the stop valve 26 is locked in position by securing the bushing 56 within the bonnet 48 such that the corresponding interlocking profiles 52, 62 are engaged. A screw 60 holds the bushing 56 within the bonnet 48. When it is desired to prevent fluid flow through one of the inlets 14, 16 the bushing 56 is raised out of the bonnet 48 such that the interlocking profiles 52 and 62 are no longer engaged. This allows for rotation of the stem 46 within the cavity to rotate and engage the piston 38. The piston 38 moves linearly within the first bore 18 to extend into the second bore 20 and seal against the inner diameter 36.

Once the desired position is reached, the stop valve 26 does not need to be locked in place by securing the screw 60 disposed at the top portion of the stem 46. Water pressure is adequate to hold the piston in place. If desired however, the stop valve (26) can be locked in place. The screw 60 forces the bushing 56 into engagement with the profiles 52 of the bonnet 48. To allow movement of the stem 46, the screw 60 is unthreaded to allow the biasing member 58 to push the bushing 56 out of engagement with the interlocking profile 52 of the bonnet 48. In a position where the bushing 56 is no longer engaged to the interlocking profiles 52 of the bonnet 48, the stem 46 is rotatable to move the piston 38 linearly between on and off positions.

As appreciated, when the screw 60 is unthreaded to allow the bushing 56 to disengage from the interlocking profiles 52 of the bonnet 48, the stem 46 is freely rotatable. Because the stem 46 is freely rotatable in such a condition, water pressure acting on a back portion 38 would force the piston 48 towards a closed position to close off fluid flow through the inlet 14. Once the stop valve 26 has shut off fluid flow from the inlet 14, the filter assembly 32 may be removed from the manifold 10 and replaced or cleaned without fluid leakage.

In operation, when it is desired to service the filter assembly 32, the stop valve 26 is moved such that the piston 38 is in a closed or sealed position. To move the piston 38 into a closed or sealed position, the screw 60 is unthreaded from the stem 46 to release the bushing 56 from the interlocking profiles 52 that are disposed within the bonnet 48. The stem 46 is then rotated to move the piston 38 to the sealed position. The sealed position is obtained when the piston moves within the second bore 20 such that the seal 42 contacts inner diameter 36 of the second bore 20.

Once the filter assembly 32 has been changed and replaced within the manifold 10, the piston 38 is moved to the fully open position. Further, the stop valve 26 is to be set and maintained in a fully opened position. The fully opened position of the stop valve 26 is accomplished by rotating the stem valve 46 such that the piston 38 is moved entirely clear of the second bore 20. Once the piston 38 is entirely clear and rotated to a fully opened position, the screw 60 is threaded into the stem 46 to push the bushing 56 into engagement with the interlocking profiles 52 disposed within the bonnet 48. In this position, the stem 46 is not movable and maintains the fully open position of the piston 38.

In the present manifold assembly 12, water directed through the inlet 14 is not required to flow through a series of transversely orientated passages within the manifold 10. Fluid flow from the inlet 14 through the first and second bores 18 and 20 is substantially linear thereby reducing any opportunity for flow noises to be propagated through the manifold 10. This also results in increased flow. In addition, the linearly aligned bores 18,20 increases fluid flow relative to prior art configurations.

In addition, the specific configuration of the faucet manifold assembly 12 simplifies the manufacturing process by enabling the stop valve 26 sealing surfaces to be fabricated in-line with the inlet 14. Because each of the bores 18, 20 are disposed along a common axis 64, machining for the stop valve assembly 26 is greatly simplified resulting in a proved manufacturing process that results in a more robust stop valve produced at a greatly reduced and advantageously economic result. The seal 42 disposed on the piston 38 seals with the inner diameter 36 of one of the second bore 20 to provide a seal that is both durable and long lasting.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A faucet manifold assembly comprising;

a manifold having first inlet, a second inlet and an outlet, each of said first inlet and said second inlet including a first bore and a second bore, said first and second bores disposed about a common axis, and said first and second inlet disposed along said common axis; and a valve assembly including a piston having a seal that seals radially against an inner surface and slides along the inner surface of one of said first and second bores for controlling fluid flow through said manifold.

2. The assembly of claim 1, further including a filter assembly intersecting said inlet.

3. The assembly of claim 2, wherein said filter assembly is removable.

4. The assembly of claim 1, wherein said piston moves along said common axis between an open and closed position.

5. The assembly of claim 1, wherein said manifold includes a transverse bore intersecting a portion of one of said first and second bores and said valve assembly is disposed within said transverse bore.

6. The assembly of claim 5, wherein said valve assembly includes a stem engaged to move said piston between said open and closed positions.

7. The assembly of claim 6, wherein said piston includes a rack gear and said valve stem includes a gear corresponding with said rack gear.

8. The assembly of claim 6, wherein said stem is held within said bore by a bonnet, said bonnet engaged to said manifold to hold said stem within said transverse bore.

9. The assembly of claim 8, including a bushing disposed within said bonnet.

10. The assembly as recited in claim 1, wherein said seal comprises an o-ring engaging said inner surface of one of said first and second bores.

11. The assembly as recited in claim 1, wherein said first bore is of a larger diameter than said second bore and said piston seals against an inner surface of said second bore.

12. A faucet manifold assembly comprising:

a manifold having an inlet and an outlet, said inlet including a first bore and a second bore, said first and second bores disposed about a common axis, said manifold including a transverse bore intersecting a portion of one of said first and second bores;

a valve assembly disposed within said transverse bore including a piston having a seal cooperating with an inner diameter of one of said first and second bores for controlling fluid flow through said manifold and a stem engaged to move said piston between said open and closed positions;

a bonnet engaged with said manifold for holding said stem within said bore, and a bushing disposed within said bonnet that is movable between an engaged and disengaged position with said bonnet.

13. The assembly of claim 9, wherein said bushing is engaged to rotate said stem.

14. The assembly of claim 12, wherein said bushing is biased toward disengagement with said bonnet by a biasing member.

15. The assembly of claim 12, wherein a threaded member engaged to said stem holds said bushing in said engaged position.

16. The assembly of claim 12, wherein said bushing prevents movement of said stem in said engaged position, and allows movement of said stem when in said disengaged position.

17. A mixing valve assembly comprising;

a manifold defining at least one inlet for fluid and at least one outlet;

a filter assembly for filtering fluid flow from said inlet to said outlet; and a stop valve assembly disposed to control fluid flow from each of said first and second inlets including a piston seal that seals radially against an inner surface of said inlet wherein said seal slides along said inner surface.

18. The assembly of claim 17, wherein said inlet includes first and second bores, said first bore having a larger diameter than said second diameter, each of said first and second bores disposed about a common axis.

19. The assembly of claim 18, wherein said piston includes a seal portion and a rack gear portion, said seal portion moving between an off position and an on position, said seal portion extending into said second bore and sealing against an inner surface of said second bore when in said off position.

20. The assembly of claim 19, wherein said stop valve includes a stem held within said housing by a bonnet and engaged to move said piston between said on and off positions.

21. A mixing valve assembly comprising:

a manifold defining at least having first and second bores and at least one outlet said first bore having a larger diameter than said second bore and each of said first and second bores disposed about a common axis;

a filter assembly for filtering fluid flow from said inlet to said outlet;

a stop valve assembly disposed to control fluid flow from each of said first and second inlets including a piston seal cooperating with an inner diameter of said inlet, said piston includes a seal portion and a rack gear portion, said seal portion moving between an off position and an on position, said seal portion extending into said second bore when in said off position, said stop valve assembly including a stem held within said housing by a bonnet and engaged to move said piston between said on and off positions; and a bushing having an outer surface engagable to an inner surface of said bonnet, said bushing movable between an engaged position and a disengaged position, said bushing preventing movement of said stem when in said engaged position and allowing movement when in said disengaged position.

22. The assembly of claim 21, including a biasing member biasing said bushing toward said disengaged position.

23. The assembly of claim 21, including a screw for holding said bushing in said engaged position.

24. The assembly as recited in claim 17, wherein said seal comprises an o-ring engaging said inner surface of said inlet.

25. The assembly as recited in claim 18, wherein said inlet includes an opening and said first bore is adjacent said opening and said second bore is spaced a distance apart from said opening.

26. A mixing valve assembly comprising:

a one piece manifold including a first inlet and a second inlet, each of said first inlet and said second inlets including a first bore adjacent an opening and a second bore smaller than said first bore spaced apart from said opening; and a first valve assembly associated with said first inlet and a second valve assembly associated with said second inlet, each of said first and second valve assemblies including a piston having a seal for radially sealing an inner surface of said second bore wherein said seal slides along said inner surface.

27. The assembly as recited in claim 26, wherein said seal is an o-ring and said piston includes a groove supporting said o-ring.

28. The assembly as recited in claim 26, wherein each of said first and second valve assemblies includes a stem secured within said manifold by a bonnet and a bushing within said bonnet movable between an engaged position preventing movement of said piston and a disengaged position allowing movement of said piston.

* * * * *

UNITED STATES PATENT AND TRADEMARK OFFICE

CERTIFICATE OF CORRECTION

PATENT NO. : 6,863,085 B2 
DATED : March 8, 2005
INVENTOR(S) : Marty, Garry Robin and McNerney, Gerald J.

It is certified that error appears in the above-identified patent and that said Letters Patent is hereby corrected as shown below:

Title page,
Item [73], Assignee, "Indianapolis, MN" should read -- Indianapolis, IN --

Signed and Sealed this

Seventh Day of June, 2005

JON W. DUDAS
*Director of the United States Patent and Trademark Office*